United States Patent [19]

Kawada

[11] Patent Number: 4,986,874

[45] Date of Patent: Jan. 22, 1991

[54] HAND-LABELER

[75] Inventor: Toshikazu Kawada, Tokyo, Japan

[73] Assignee: Towa Seiko Kabushiki Kaisha, Tokyo, Japan

[21] Appl. No.: 404,014

[22] Filed: Sep. 7, 1989

[51] Int. Cl.[5] ..... B65C 9/18; B65C 11/00

[52] U.S. Cl. ..... 156/577; 156/579; 156/DIG. 48

[58] Field of Search ..... 156/384, 577, 579, DIG. 48, 156/DIG. 49; 101/288

[56] References Cited

U.S. PATENT DOCUMENTS 3,619,324 11/1971 Sato et al. ..... 156/384
4,072,105 2/1978 Becker et al. ..... 101/288
4,453,999 6/1984 Holland-Letz ..... 101/288
4,544,433 10/1985 Schrotz et al. ..... 156/384

*Primary Examiner*—Michael G. Wityshyn
*Attorney, Agent, or Firm*—Armstrong, Nikaido, Marmelstein, Kubovcik & Murray

[57] ABSTRACT

A hand-labeler for automatically and consecutively removing discrete labels from a label-carrying tape and putting each label on an object. In order to permit automatic adjustment of an intermittent feeding length to meet a particular label size and inter-label space, the labeler uses a swingable feeler and a lever stop operatively connected to the feeler to cause the lever stop to tilt upon collision of the feeler against the forward end of each discrete label, thereby stopping the label-carrying tape feeder after feeding each interval length in conformity with the label size plus inter-label space.

1 Claim, 5 Drawing Sheets

FIG. 4a
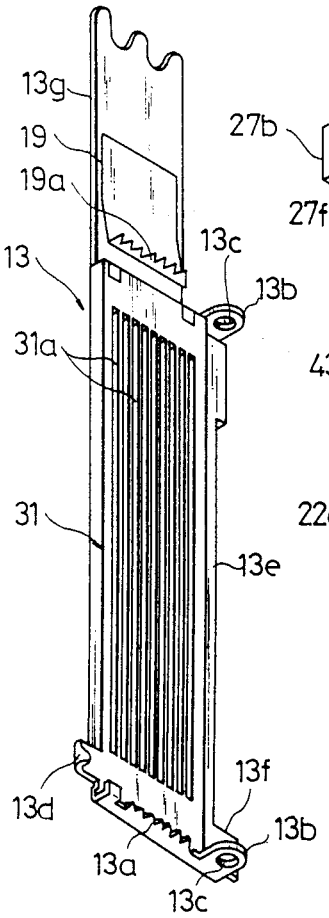
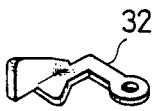
FIG. 4b
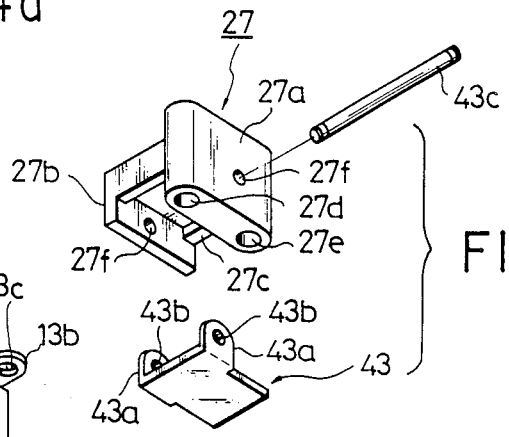
FIG. 4c
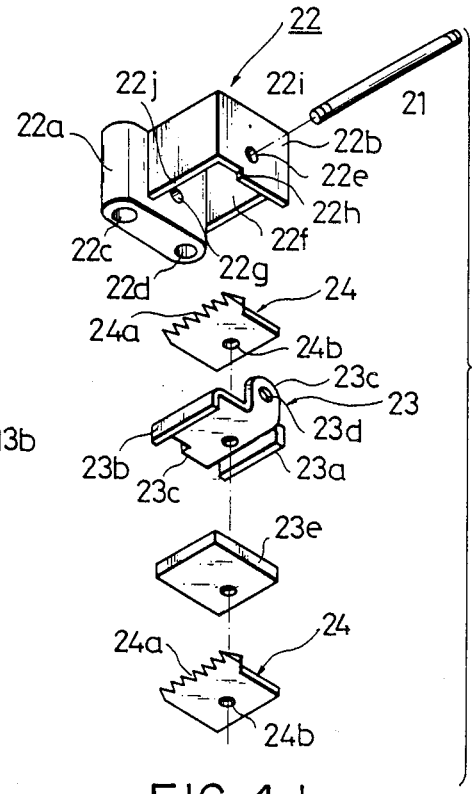
FIG. 4d
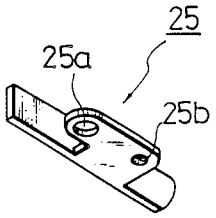
FIG. 4e
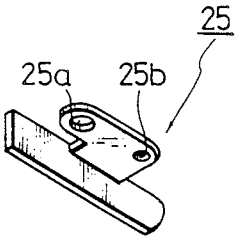
FIG. 4f

HAND-LABELER

BACKGROUND OF THE INVENTION

1. Field of the Invention

The present invention relates to a hand-labeler for automatically and consecutively removing discrete labels from a label-carrying tape and putting each label on an object.

2. Related Art

A conventional hand-labeler is equipped with a movable stopper for setting the desired stroke of a slidable block, thereby adjusting the interval length by which a label-carrying tape is intermittently fed to meet the label size. The slidable block is fixed in position by an associated bolt for example.

Manual adjustment of the intermittent feeding length is not easy, and the precise adjustment is attained with difficulty.

SUMMARY OF THE INVENTION

In view of this, the object of the present invention is to provide a hand-labeler which permits automatic adjustment of intermittent feeding length to meet a particular label size and inter-label space.

To attain this object, a labeler which has a label-carrying tape feeder operatively connected to stationary and movable handles to permit the start and stop feeding of the label-carrying tape in response to each operation of the handles, thereby separating each label from the label-carrying tape and putting it on an object, is improved according to the present invention in that the labeler comprises: a body to which the stationary handle is integrally connected and the movable handle is rotatably fixed; a feeler mount swingably fixed to the body; a feeler swingably fixed to the end of the feeler mount to vary its angular position upon collision of the free end of the feeler against the forward end of each discrete label on the label-carrying tape during the start and stop feeding of the tape, thereby causing a corresponding angular displacement of the feeler mount; a lever stop operatively connected both to the label-carrying tape feeder and to the feeler mount, thereby causing the lever stop to make a controlled angular displacement in response to the corresponding angular displacement of the feeler mount to permit the label-carrying tape feeder to perform an automatic adjustment of each interval length in conformity with the label size plus inter-label space; and a release unit to set the free end of the feeler free of the forward end of each discrete label every time the handles are restored to their stress-free initial position.

Other objects and advantages will be understood from the following description of a hand-labeler according to one embodiment of the present invention, which is shown in accompanying drawings:

BRIEF DESCRIPTION OF THE DRAWINGS

FIGS. 4(*a*)–4(*f*) and 5 are exploded views of selected parts of the labeler.

PREFERRED EMBODIMENT OF THE INVENTION

Figure 1:
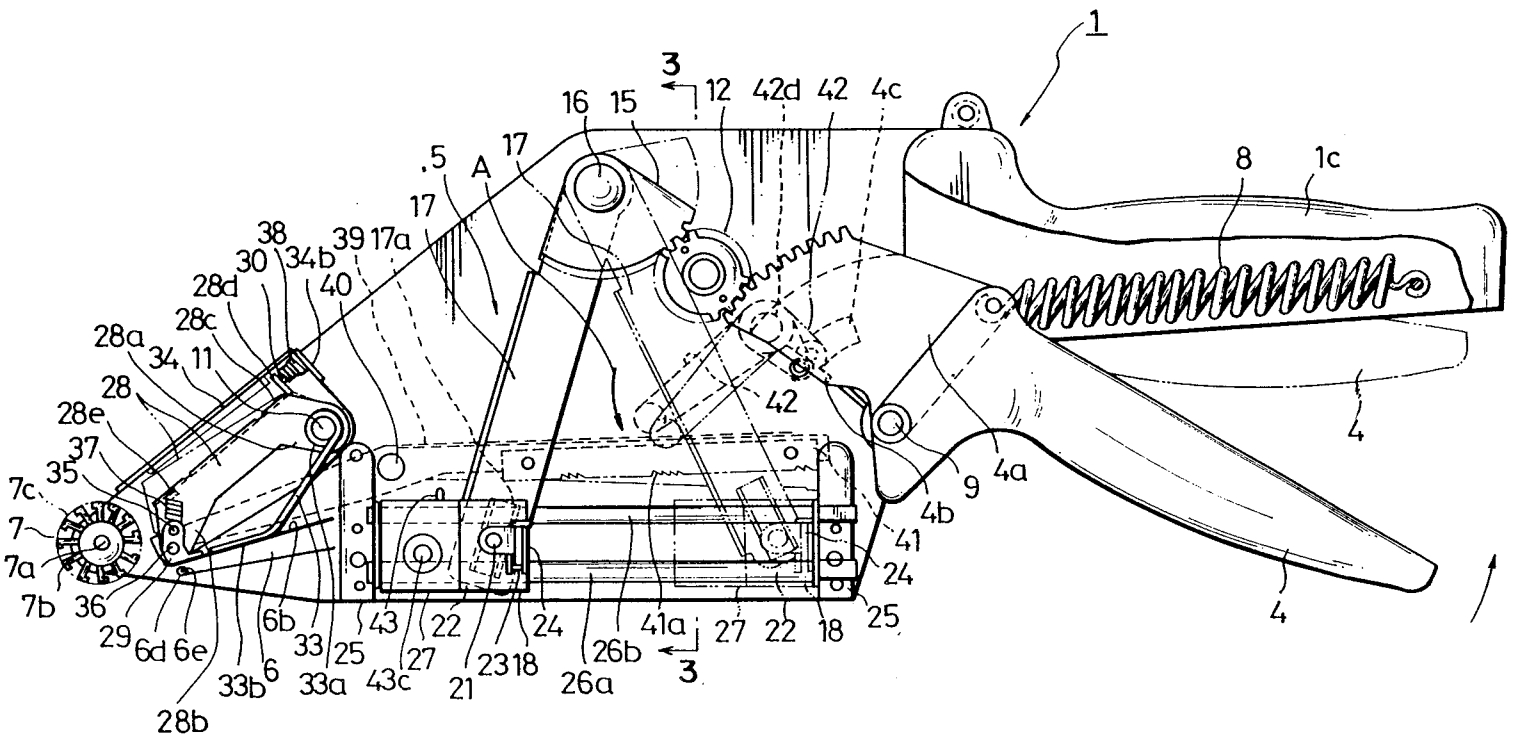
FIG. 1 is a schematic side view of the hand-labeler, showing parts which are related to the claimed structure.
Figure 2:
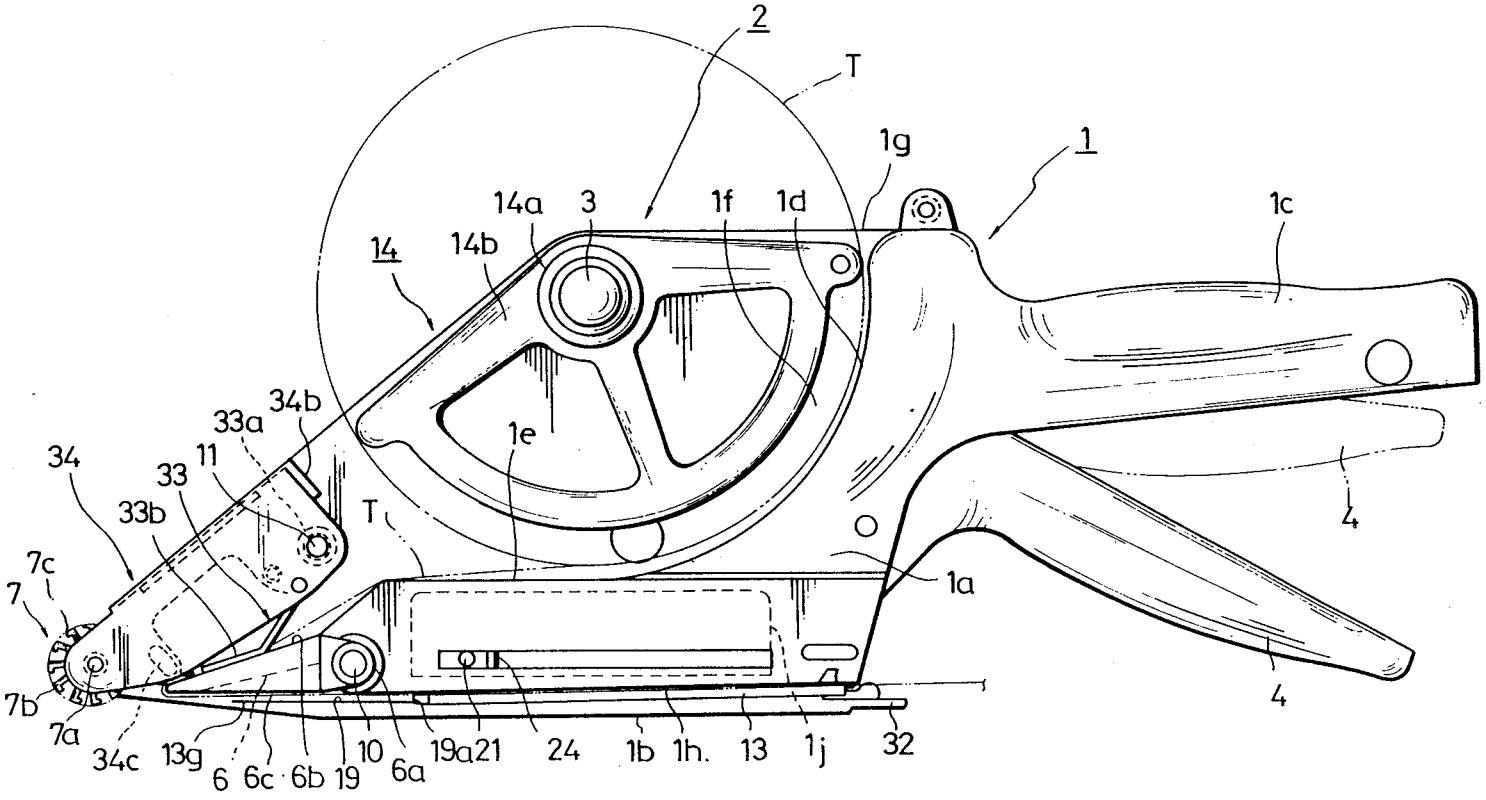
FIG. 2 is a similar side view, but showing the general structure of the labeler.

Referring to FIGS. 1 and 2, a hand labeler is indicated at 1. It comprises a body to which a stationary handle 1*c* is integrally connected and a movable handle 4 is rotatably connected. The labeler has a label-carrying tape feeder 5 operatively connected to the stationary and movable handles 1*c* and 4 to permit the start and stop feeding of the label-carrying tape T in response to each operation of the handles.

As shown in FIG. 1, a feeler mount 28 is swingably fixed to the body to rotate about its pivot 11. A feeler 29 is swingably fixed to the end of the feeler mount 28 to rotate about its pivot 36. The feeler 29 will vary its angular position upon collision of the free end of the feeler 29 against the forward end of each discrete label $L_1$ on the label-carrying tape T during the start and stop feeding of the tape, as seen from FIG. 5. This will cause a corresponding angular displacement of the feeler mount 28. A lever stop 39 is operatively connected both to the label-carrying tape feeder 5 and to the feeler mount 28. Thus, the lever stop 39 will rotate about its pivot 40 in unison with the angular displacement of the feeler mount 28, thereby making a controlled angular displacement to permit the label-carrying tape feeder 5 to perform an automatic adjustment of each interval length in conformity with the label size plus inter-label space. More particularly, a slidable block 22 of the label-carrying tape feeder 5 grips the end of tape T to advance a controlled distance until the slidable block 22 is made to stop by the lever stop 39 as will be later described in detail. When the handles are released and when the label-carrying tape feeder 5 is restored to its initial position, a release unit 42 will set the free end of the feeler 29 free of the forward end of the subsequent discrete label.

The labeler body comprises opposite side plates 1*a* and 1*b*. The stationary handle 1*c* is integrally connected to these opposite side plates and the movable handle 4 is pivoted to the side plates at 9 and is spring-biased to its open position by a spring 8. One of these side plates 1*a* has a recess 1*g* to accomodate a part of the label carrying tape roll. The recess 1*g* is outlined by an arc wall 1*d* and a contiguous flat wall 1*e* both standing upright on a flat base 1*f*. The opposite side plates 1*a* and 1*b* are integrally connected to leave a longitudinal opening 1*h* on its bottom. The side plate 1*a* has a roll-supporting axle 3, a guide axle 10 and a guide protrusion 11 integrally connected to the side plate 1*a* in the form of cantilever.

Figure 3:
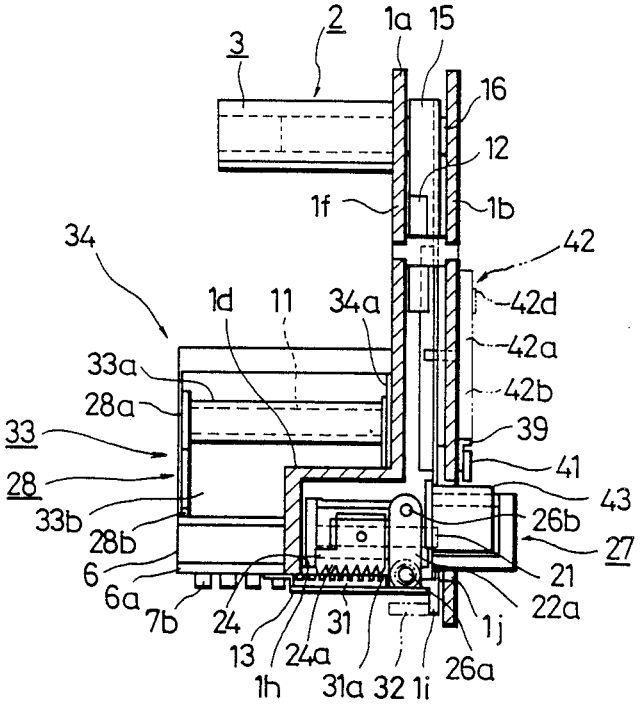
FIG. 3 is a sectional view taken along line 3—3 and viewed in the direction indicated by arrows in FIG. 1.

The labeler body 1 has a swingable bottom plate 13 to close the longitudinal opening 1*h*, leaving a slot 1*i* between the bottom plate 13 and the other side plate 1*b*. The side plate 1*b* has a longitudinal rectangular opening 1*j* extending from the vicinity of the cantilever guide axle 10 to the vicinity of the movable handle 4 along a guide rod 26*a* (later described) as seen from FIGS. 1 and 3. As for the roll retainer section 2 it is made up by the roll-supporting axle 3 and a roll-positioning member 14 fitted to the roll-supporting axle 3. The roll-supporting axle 3 is placed at the center of the circle a part of which falls on the arc wall 1*d*, and the roll-supporting axle 3 is integrally connected to the flat base 1*f* of the side plate 1*a*. The roll-positioning member 14 is made up by a hollow cylinder 14*a* and a sector 14*b* both integrally connected. The roll retainer section 2 is detachably fixed to the labeler with its hollow cylinder 14a fitted on the roll-supporting axle 3.

The label-carrying tape feeder 5 is built in the labeler 1, and is made up by a segment 4a integrally connected to the movable handle 4, an intermediate gear wheel 12 meshing with the segment 4a, a main segment 15 meshing with the intermediate gear wheel 12, a tape feeding lever 17 integrally connected to the main segment 15 and rotatable about a common pivot 16, a tape feeding nail 18 connected to the tape feeding lever 17 and slidable on the inside surface of the bottom plate 13 and a tape reverse blocking nail 19.

A peeling guide 6 is pivoted about the cantilever axle 10 as indicated at 6a, and the peeling guide extends opposite to the stationary handle 1c to provide an inner tape guide surface 6b and an outer tape guide surface 6c. As seen from FIG. 2, these guide surfaces 6b and 6c converge to an acute angle. The tapering end of the peeling guide 6 has a wire 6d stretched across and a small hollow roll 6e loosely fitted about the stretched wire, thus permitting the smooth feeding of the tape.

A label applicator roll 7 for applying a peeled label to an object comprises an axle 7a extending parallel to the roll-supporting axle 3 and a plurality of resilient spokes 7b. These spokes 7b are arranged so as to have their tips on an imaginary circle 7c (broken line), which is apart by a given constant distance from the small hollow roll 6e of the peeling guide 6. The label applicator roll 7 is pivoted to a bracket 34 as indicated at 7a. The base 34a of the bracket 34 is fixed to the labeler housing. A guide plate 33 comprises a rolled end 33a and a flat bent surface 33b integrally connected to and extending from the rolled end 33a, and the guide plate 33 is pivotally fixed to a guide protrusion 11. The flat bent surface 33b of the guide plate 33 is laid on the inner tape guide surface 6b of the peeling guide 6, thus assuring that the tape is guided to travel along a predetermined passage.

As shown in FIG. 4(a), the swingable bottom plate 13 comprises a longitudinal plate 13g having a bent lateral serrate edge 13a, a hook 13d and a lock piece 13f integrally formed on opposite longitudinal sides in the vicinity of each of the serrate edge 13a, two support ears 13c each having one aperture; a longitudinal slotted guide plate 31 fixed to the major surface of the longitudinal plate; and a resilient serrate nail 19. The swingable bottom plate 13 is rotatably fixed to the side plate 1b of the labeler housing in the form of cantilever by inserting a rod 26 in the apertures 13c of the support ears 13b and corresponding aperturers of the labeler housing. The swingable bottom plate 13 can be closed by engaging the lock piece 13f of the longitudinal plate 31 with a catch lever 32, which is pivoted to the side plate 1b of the labeler housing. As shown in FIG. 4(d), a tape feeding nail assembly 18 comprises a slide block 22, a swingable plate 23 rotatably fitted in the slide block 22, and two serrate nails 24 fixed to the opposite sides of the swingable plate 23. The longitudinal slotted guide plate 31 has parallel slots 31a of the same number and pitch of the teeth 24a of each serrate nail 24. Thus, the tape T can be caught between the slotted surface of the bottom plate 13 and the teeth 24a of the serrate nails 24 of the feeding nail assembly 18, and the tape T can be fed forward when the serrate nails 24 are moved forward on the slotted surface of the bottom plate.

The tape feeding lever 17 has a slot 17a made in its free end, and the tape feeding nail assembly 18 is connected to the tape feeding lever 17 by inserting a nail axle 21 in the slot 17a of the tape feeding lever 17, thereby permitting the tape feeding nail assembly 18 to slide back and forth on the slotted surface of the bottom plate 13.

The resilient serrate nail 19 has sawtooth 19a on its bent edge. The sawtooth 19a is kept in resilient contact with the upper surface of the tape T. When the tape T is fed forward, the serrate nail 19 is yieldingly bent, thereby allowing the tape T to advance forward. The resilient nail 19 is responsive to the backward move of the tape T for raising its serrate edge 19a, thereby catching and preventing the tape T from moving backward.

As seen from FIG. 4(d) the slide block 22 has a slide guide 22a and a serrate nail holder frame 22b integrally connected together. The slide guide 22a has parallel vertical guide holes 22c and 22d and a horizontal axle hole 22g between these guide holes 22c and 22d. The serrate nail holder frame 22b has a rectangular space 22f and a counter hole 22e in alignment with the horizontal axle hole 22g. Also, the serrate nail holder frame 22b has a notch 22j made in the bottom edges of its opposite sides to leave a raised edge 22h on its rear side.

Support metals 25 are fixed to the side plate 1b of the labeler housing, and guide rods 26a and 25b are inserted in the apertures 25a and 25b of the support metals 25 and the guide holes 22c and 22d of the slide block 22, thus permitting the slide block 22 to move back and forth.

The swingable plate 23 is composed of a piece of metal plate having opposite edges 23a and 23b bent perpendicular to the major surface of the metal plate and narrow support portions 23c of the remaining opposite edges bent perpendicular to the major surface of the metal plate in the direction opposite to the bent edges 23a and 23b. Each serrate nail 24 has a sawtooth 24a and an aperture 24b. One serrate nail 24 and a spacer 23e are fitted in the space defined by the opposite bent edges 23a and 23b of the swingable plate 23, and the other serrate nail 24 is applied to the other side of the swingable plate 23. A rivet is inserted in the apertures of these serrate nails 24, spacer 23e, and swingable plate 23, and these parts are fastened together. The assembly thus integrated is swingably fixed to the slide block 22 by inserting a rod 21 into the apertures 22b and 22g of the slide block 22 and the apertures of the support portions 23c of the swingable plate 23. The swingable assembly is biased by a spring (not shown) wound about a rod 21 so that it is pushed against the edge 22j of the slide block frame. The sawtooth of the serrate nails 24 appear beyond the notched edge 22j of the slide block frame. An adjustment nail 43 for adjusting the interval length of tape is fixed to an adjustment block 27, which is combined with the slide block 22 as later described.

When the movable hand 4 is not moved towards the stationary handle 1c, the tape feeding nail assembly 18 is brought to one terminal end of the elongated slot 1j as shown in FIG. 1 (solid lines). When the movable hand 4 is moved towards the stationary handle 1c, the tape feeding nail assembly 18 with its serrate nails 24 upright moves toward the other terminal end of the elongated slot 1j (broken lines), causing an interval length of tape to move forward. When the movable handle 4 is restored to its initial open position by the spring 8, the tape feeding nail assembly 18 is brought back to the initial position.

As for the adjustment block 27 it comprises a base 27a, a flat 27b spaced from the base 27a in parallel relation, and an intervenient receptacle 27c integrally connected to the base 27a and the flat 27b. The base 27a has vertical holes 27d and 27e and a horizontal hole 27f, and the flat 27b has a horizontal hole 27f. Guide rods 26a and 26b are inserted in these vertical holes 27d and 27e of the base 27a and the vertical holes 22c and 22d of the slide block 22. The adjustment block 27 thus combined with the slide block 22 can slide along with the slide block 22. The adjustment nail 43 is a piece of metal plate having support ears 43a and 43b bent perpendicular to its major surface. This adjustment nail 43 is inserted in the intervenient receptacle 27c of the adjustment block 27 with the apertures 43b of the support ears 43a in alignment with the aperture 27f of the flat 27b and the aperture 27f of the base 27a of the adjustment block 27. The adjustment nail 43 is swingably fixed to the adjustment block 27 by inserting a rod 43c in these aligned apertures. The adjustment nail 43 is biased by a spring (not shown) would about the rod 43c so that the adjustment nail 43 is pushed against the edge of the intervenient receptacle 27c of the adjustment block 27.

While the slide block 22 moves forward, the adjustment nail 43 of the adjustment block 27 will be caught by a selected sawtooth 41a of a serrate lever stop 41 (later described), thereby causing the slide block 22 to stop after the tape T is fed by an interval length corresponding to the label size plus inter-label space. On the return to the initial position the top edge of the adjustment nail 43 will be released from the sawtooth of the serrate lever stop 41, and the slide block 22 along with the adjustment block 27 will smoothly return to the initial position.

The feeler mount 28 comprises a rectangular frame having parallel longitudinal arms 28a, two front pieces 28b each having an aperture 28f and integrally connected to the forward ends of the opposite longitudinal arms 28a, two rear pieces each having an aperture 28g and integrally connected to the rear ends of the opposite longitudinal arms 28a, a lateral front piece 28e having a lateral slot and integrally connected to the opposite longitudinal arms 28a, a lateral rear piece 28c having an erection 28d with a pin 30 projecting rearward. The feeler mount 28 is swingably fixed to the labeler housing by inserting the guide projection 11 in the apertures 28g of the rear pieces of the feeler mount 28. The feeler 29 is swingably attached to the feeler mount 28 by inserting an axle rod 36 in the apertures 28f of the front pieces of the feeler mount 28. As shown in FIG. 1, a compression spring 38 is fitted around the pin 30 of the feeler mount 28, and is retained between the erection 28d of the feeler mount 28 and a pressing plate 34b, which is integrally connected to the bracket 34. Thus, the forward pieces 28b of the feeler mount 28 are spring-biased to tilt towards the tape T.

Figure 5:
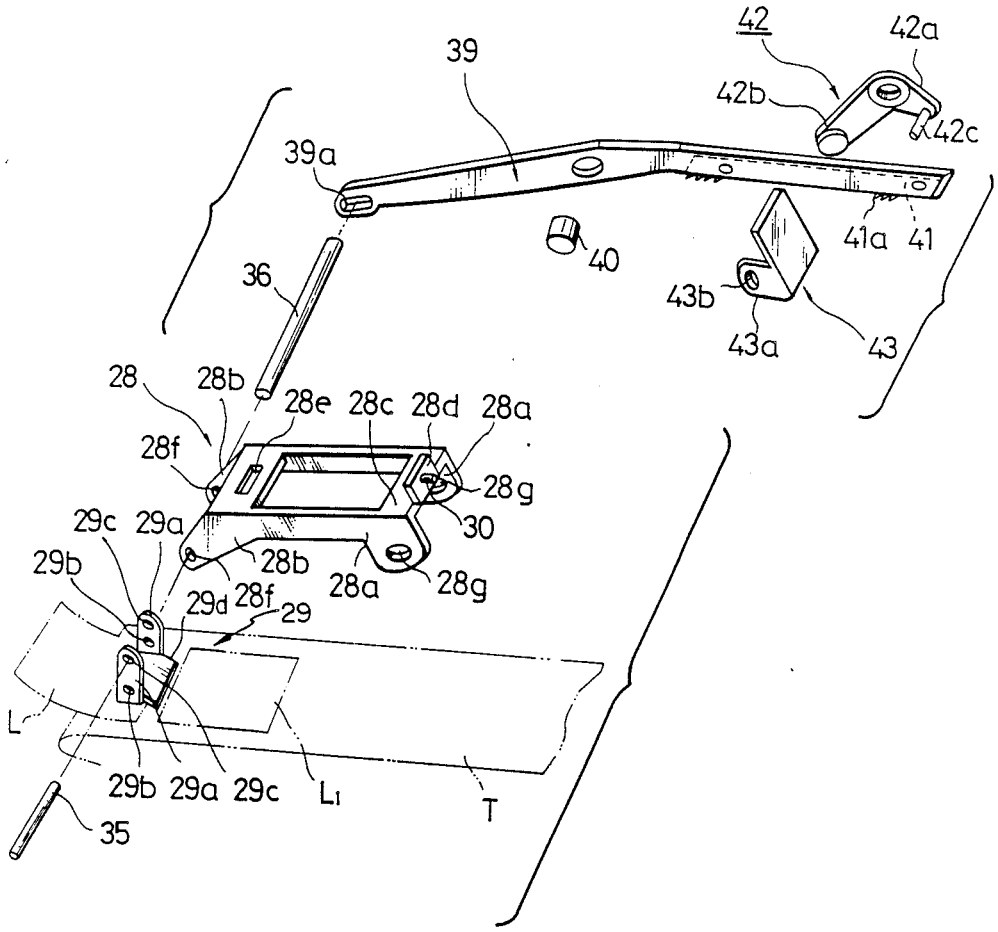

As best shown in FIG. 5, the feeler 29 is a generally U-shaped metal having a lateral slant 29d and two opposite legs 29a each having two apertures 29b and 29c. The feeler 29 is swingably attached to the feeler mount 28 by inserting the axle rod 36 in the apertures 28f of the feeler mount 28 and the lower apertures 29b of the feeler 29. The feeler 29 has a pin 35 inserted in its upper apertures 29c. One end of a spring 37 is fixed to the lateral slot of the feeler mount 28, and the other end of the spring 37 is fixed to the pin 35 of the feeler 29. Thus, the feeler 29 is spring-biased for the lateral slant 29d of the feeler 29 to give a light touch to the tape T. When the movable handle 4 is not moved, the lateral slant 29d of the feeler 29 is brought in contact with the tape just ahead of a first label to be peeled off from the tape.

When the movable handle 4 is moved toward the stationary handle 1c to cause an interval length of tape to advance forward, the lateral slant 29d of the feeler 29 will come into contact with the front edge of the label $L_1$ to tilt, thereby causing the feeler mount 28 to tilt by the counter force from the guide surface 6b of the guide member 6, and causing the serrate lever stop 39 to tilt through the agency of the axle 36 until a selected sawtooth 41a of the serrate lever stop 39 has come to engagement with the adjustment nail 43 of the adjustment block 27, thus making the adjustment block 27 to stop at a controlled position.

The rod 36 is inserted in the slots (not shown) made in the opposite side plates 1a and 1b of the labeler housing and in the slots 34c of the bracket 34 so that the rod 36 can move in these slots. Also, the rod 36 is inserted in the slot 39a of one end of the serrate lever stop 39.

The serrate lever stop 39 is swingably fixed to the side plate 1b about a pivot 40. The serrate lever stop 39 has a serration 41 fixed to the end thereof opposite to the end at which the rod 36 is loosely fixed. As seen from FIG. 5, the serration 41 is fixed to the lever stop 39 with its sawtooth 41a facing the tape feeding nail 18 of the tape feeding mechanism 5.

As best seen from FIG. 5, the release member 42 is a bent metal piece comprising shorter and longer arms 42a and 42b. The shorter arm 42a has a pin 42c fixed to its end whereas the longer arm 42b has a contact fixed to its end. The release member 42 is swingably fixed to the slide plate 1b of the labeler housing, thus permitting the release member 42 to rotate about its pivot 42d, as seen from FIG. 1. The release member 42 is pivoted with its shorter arm 42a close to the segment 4a of the movable handle 4 and with its longer arm 42b close to the control lever 39. In particular, the pin 42c of the shorter arm 42a is put in contact with a pusher 4b which is integrally connected to the segment edge of the movable hand 4, and the pin 42c is put in a sector slot 4c which is made adjacent to the pusher 4b in the segment of the movable handle 4. When the movable handle 4 is released to return to its initial open position, the pusher 4b will push the pin 42c to cause the release member 42 to rotate in the direction as indicated by arrow A. Then, the contact of the longer arm 42b will push the serrate end of the lever stop 39, thereby causing the front end of the feeler mount 28 and the lateral slant 29c of the feeler 29 to move apart from the tape T through the agency of the rod 36. Then, the feeler 29 will return from vertical posture to initial horizontal posture under the resilient influence of the pull spring 37.

The operation of the labeler is described below.

First, a tape roll is fitted in the roll holding recess 3, and a drawn length of tape travels on the sector and level surface 1d and 1e, passing between the guide surface 6b of the peeling guide member 6 and the guide plate 33 and then between the guide surface 6b and the feeler 29, turning around the front end of the peeling guide member 6, traveling on the swingable bottom plate 13 and finally appearing out of the serrate end 13a of the swingable bottom plate 13.

When the movable handle 4 is moved toward the stationary handle 1c, the serrate nail 24a of the tape feeding nail assembly 18 will be pushed against the bottom plate 13 to seize the tape thereon, and the tape feeding nail assembly 18 slides forward along the guide rod 26a, thereby drawing an interval length of tape forward. Then, the tape turns around the front end of the peeling guide member 6 to allow the label L to advance straight, leaving the turning and traveling tape T. The feeler 29 comes to contact with the front edge of the subsequent label $L_1$ to erect on the guide surface 6b of the peeling guide member 6. Then, a counter force is applied from the guide surface 6b to the feeler 29, thereby causing the feeler mount 28 to tilt, and causing the lever stop 39 to tilt through the agency of the connecting rod 36 until a selected saw-tooth of the serration 41 catches edge of the adjustment nail 43, thereby causing the slide block 22 and the tape feeding nail assembly 18 to stop after an interval length of the tape T is allowed to advance. The label L thus peeled off from the tape T remains on selected resilient spokes 7b with its adhesive side facing outward. Then, the label L is applied to an object.

When the movable handle 4 is released to restore to its initial open position under the resilient influence of the pull spring 8, the adjustment nail 43 moves on the slant of the selected saw-tooth of the serration 41 to leave the receptacle 27c of the adjustment block 27. Within three degrees ahead of the terminal end of the return path, the pusher 4b comes to collision to the pin 42c of the release member 42, thereby causing the release member 42 to tilt and push the lever stop 39 with its contact protrusion. As a result the feeler 29 moves apart from the tape T on the guide surface 6b toward the initial position under the resilient influence of the pull spring 37.

The tape retainer 3, the peeling guide member 6 and the swingable bottom plate 13 are fixed to the side plate of the labeler housing in the form of cantilever. With this cantilever arrangement tapes of different widths can be used no matter how wide or narrow the tape may be.

A labeler may use a tape feeding mechanism having a pair of rolls. A serrate disc may be fixed about a roll axle, and may be placed at such a position that an angular displacement of a lever stop 39 causes its adjustment nail 43 to be caught by a selected saw-tooth of the serrate disc, thereby making the rolls to stop.

I claim:

1. A labeler which has a label-carrying tape feeder operatively connected to stationary and movable handles to permit the start and stop feeding of a label-carrying tape in response to each operation of the handles, thereby separating each label from the label-carrying tape and putting it on an object, characterized in that said labeler comprises:

a body to which said stationary handle is integrally connected and said movable handle is rotatably fixed;

a feeler mount swingably fixed to said body;

a feeler swingably fixed to an end of said feeler mount to vary an angular position of said feeler relative to said feeler mount upon collision of a free end of said feeler against a forward end of each discrete label on the label-carrying tape during the start and stop feeding of the tape, thereby causing a corresponding angular displacement of said feeler mount;

a lever stop pivotally connected to said body and to said feeler mount, whereby said lever stop is pivotally displaced relative to said body in response to said angular displacement of said feeler mount to permit said label-carrying tape feeder to perform an automatic adjustment of each interval length of the label-carrying tape corresponding to the label size plus inter-label space; and a release unit operative to release said lever stop to return to an original position and to release the free end of said feeler from the forward end of each discrete label as said handles are released and restored to their stress-free initial position.

* * * * *